US006306482B1

(12) United States Patent
Ruppel et al.

(10) Patent No.: US 6,306,482 B1
(45) **Date of Patent: *Oct. 23, 2001**

(54) METHOD FOR MAKING AN ABSORBENT STRUCTURE

(75) Inventors: Rémy Ruppel, Durrenentzen; Joel Hungler, Urschenheim; Pierre Laurent, Colmar, all of (FR)

(73) Assignee: Georgia-Pacific France, Kunheim (FR)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 08/952,730

(22) PCT Filed: Mar. 27, 1997

(86) PCT No.: PCT/FR97/00562

§ 371 Date: Dec. 11, 1997

§ 102(e) Date: Dec. 11, 1997

(87) PCT Pub. No.: WO97/35712

PCT Pub. Date: Oct. 2, 1997

(30) Foreign Application Priority Data

Mar. 7, 1996 (FR) ..... 96 03779

(51) Int. Cl.[7] ..... B31F 1/07

(52) U.S. Cl. ..... 428/154; 156/209; 156/210; 156/290; 156/291; 156/292; 428/166; 428/172; 428/179; 428/198

(58) Field of Search ..... 156/209, 210, 156/219, 290, 291, 292, 547, 549, 550, 553, 555, 556; 428/154, 172, 173, 219, 156, 166, 198, 179

(56) References Cited

U.S. PATENT DOCUMENTS

| | | | | |
|---|---|---|---|---|
| 3,708,366 | | 1/1973 | Donnelly . | |
| 3,867,225 | * | 2/1975 | Nystrand | 156/209 |
| 4,093,765 | * | 6/1978 | Schmidt | 428/134 |
| 4,483,728 | * | 11/1984 | Bauernfeind | 156/209 |
| 4,543,142 | | 9/1985 | Kuepper et al. . | |
| 5,693,406 | * | 12/1997 | Wegele et al. | 428/179 |
| 5,830,558 | * | 11/1998 | Barnholtz | 428/171 |

FOREIGN PATENT DOCUMENTS

WO 94 15776 7/1994 (WO) .

* cited by examiner

*Primary Examiner*—Jeff H. Aftergut
(74) *Attorney, Agent, or Firm*—Breiner & Breiner, L.L.C.

(57) ABSTRACT

The invention relates to a manufacturing method for an absorbent structure (10) having at least two plies (P1, P2) each constituted of at least one embossed sheet of creped absorbent paper, wherein the plies (P1, P2) engage between two engraved metal cylinders (CG1, CG2) fitted with protrusions (R1, R2), driven in synchronized rotation, and mutually nesting with a play (J) between the tops of the protrusions (R1, R2) of one metal cylinder (CG1, CG2) and the opposite trough surface (F2, F1) of the engraving of the other cylinder (CG2, CG1), the method being characterized in that the play (J) is less than the depth of the cylinder engravings and larger than the sum of the thicknesses (E1, E2) of the plies (P1, P2) which were previously shaped in such a matching manner that the plies (P1, P2) are not compressed when being engaged between the nested engraved cylinders (CG1, CG2).

4 Claims, 2 Drawing Sheets

METHOD FOR MAKING AN ABSORBENT STRUCTURE

The present invention concerns a manufacturing method for an absorbent structure or web of at least two plies each constituted of at least one creped absorbent sheet of embossed paper.

In particular, the invention relates to making fiber products in the form of absorbent papers for household and sanitary uses.

Accordingly, the invention more specifically concerns an absorbent structure having several plies, which is also called a multi-layer structure, for products such as toilet paper, handkerchiefs, napkins, or paper towels.

The sanitary and household paper industry manufactures a variety of different products using a lightweight creped absorbent paper such as cellulose wadding or tissue paper. The stretching properties of this paper made possible by its creping is used to emboss it.

Embossing imparts bulk to the web and improves liquid absorption, touch and softness. Attempts have been made already to improve absorptivity further by creating multi-layer structures by combining at least two layers, also called plies, each constituted by at least one embossed creped absorbent paper sheet.

French Patent No. 93 00366 already proposes a method for making an absorbent structure having at least two plies, namely

- a method wherein the plies are engaged between two engraved metal cylinders fitted with protrusions and driven in synchronized rotation and mutually nesting with play between the tops of the protrusions of one metal cylinder and the opposite trough surface of the engraving of the other cylinder,
- a method wherein, prior to its engagement between the two engraved cylinders, each ply is shaped to follow the surface of its associated engraved cylinder by forcing the ply against the cylinder by means of an associated compression cylinder fitted with a flexible cladding, in particular an elastomer or rubber cladding,
- a method wherein an adhesive is applied to the salient zones of at least one ply before the plies are engaged between the engraved cylinders.

In the method described in the document, the magnitude of the play J is selected to be no more than the thickness of the web being embossed in order to ensure calendering the web near the tops of the bosses implemented when combining the plies in the zone. However, the method entails the drawback of requiring cylinders with very tight engraving tolerances, raising complexity on an industrial scale.

Moreover, a "nested" method is known in the prior art whereby the two cylinders are sufficiently apart from each other so that, after embossing, one of the plies is detached from the cylinder and is applied against the second engraving cylinder bearing the second ply in such a manner that the protrusions of the first ply shall nest between the protrusions of the second ply. A rubber-clad laminator roll presses the first against the second ply in a manner to ensure contact between the adhesive-endowed tops of the second and first plies and their combination. This technique is shown in U.S. Pat. No. 3,867,225.

Applicant, however, observed that at very high embossing pressures, sometimes such a method results in fluttering of the ply detached off its metal embossing cylinder in the zone upstream of the laminator roll and the associated metal engraved cylinder when the ply passes through the zone in the direction of the laminator roll.

This fluttering results in forming a loop entailing an offset between the two plies and hence manufacturing defects because of the lack of registry of the two plies when they are bonded together by the laminator roll.

Besides the difficulty in maintaining synchronized displacement of the two plies before they are adhesively combined by the laminator roll, this technique furthermore incurs the drawback of requiring adequate compression of the laminator roll and one of the two engraved cylinders to achieve good adhesive bonding of the previously two plies.

On account of the resiliency of the laminator roll, the application of a comparatively large compression will entail additional or new embossing of the outer ply relative to the engraved cylinder associated with the laminator roll, whereby product aesthetics as well as softness of touch will be degraded.

The object of the present invention is to create a method combining the advantages of the two above-mentioned methods while nevertheless remedying the already described drawbacks.

For that purpose, the invention proposes a method wherein the engraved cylinders are apart by a play J measured between the tops of one cylinder and the engraved trough surface of the other cylinder and are characterized in that the play J is larger than the sum of the thicknesses of the previously shaped plies in such a manner that the plies are not compressed when being engaged between the nested engraved cylinders and in that the play J is less than the engraved depth of the cylinders.

Also the invention proposes apparatus with which to implement the method of the invention, the apparatus comprising two engraved metal cylinders fitted with protrusions and driven into synchronized rotation and mutually nesting with a play J between the tops of the protrusions of one metal cylinder and the opposite trough surface of the engraving of the other cylinder, the previously embossed plies being engaged between the cylinders, the apparatus being characterized in that the play J is larger than the sum of the thicknesses of the previously embossed plies.

Moreover, the invention proposes an absorbent structure of at least two absorbent plies made in the manner of the invention and characterized in that it evinces absorptivity measured under the AFNOR NFQ 03068 Standard exceeding 10 $cm^3/g$, in particular between 11 and 14 $cm^3/g$, when it is made from two sheets of creped absorbent paper each with an absorptivity between 4 and 6 $cm^3/g$.

Other features and advantages of the invention are elucidated in the following comprehensive description and in relation to the attached drawings.

Figure 1:
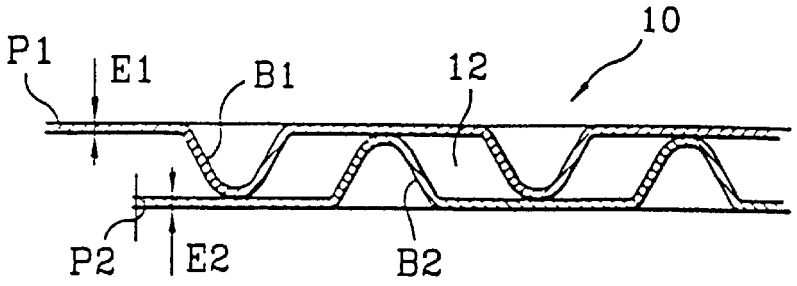
FIG. 1 is a cross-section of a two ply absorbent structure.

The cross-section of FIG. 1 shows a web or structure 10 having two plies P1 and P2 nesting in each other.

The ply P1 comprises embossed and mutually spaced bosses B1 which point in the direction of ply P2 which in turn symmetrically comprises bosses B2 pointing toward ply P1.

The bosses B2 nest between the bosses B1 and the gap between the bosses B1 and B2 is sufficient to subtend a space 12.

Each ply or foil P1 and P2 is a cellulose wadding, i.e., tissue-paper sheet of creped absorbent paper used as a sanitary or household paper having a specific surface weight of between 10 and 40 g/m$^2$.

The thicknesses E1, E2 of the plies P1, P2, respectively, may be identical and, for example, their order of magnitude may be 0.1 mm.

Figure 2:
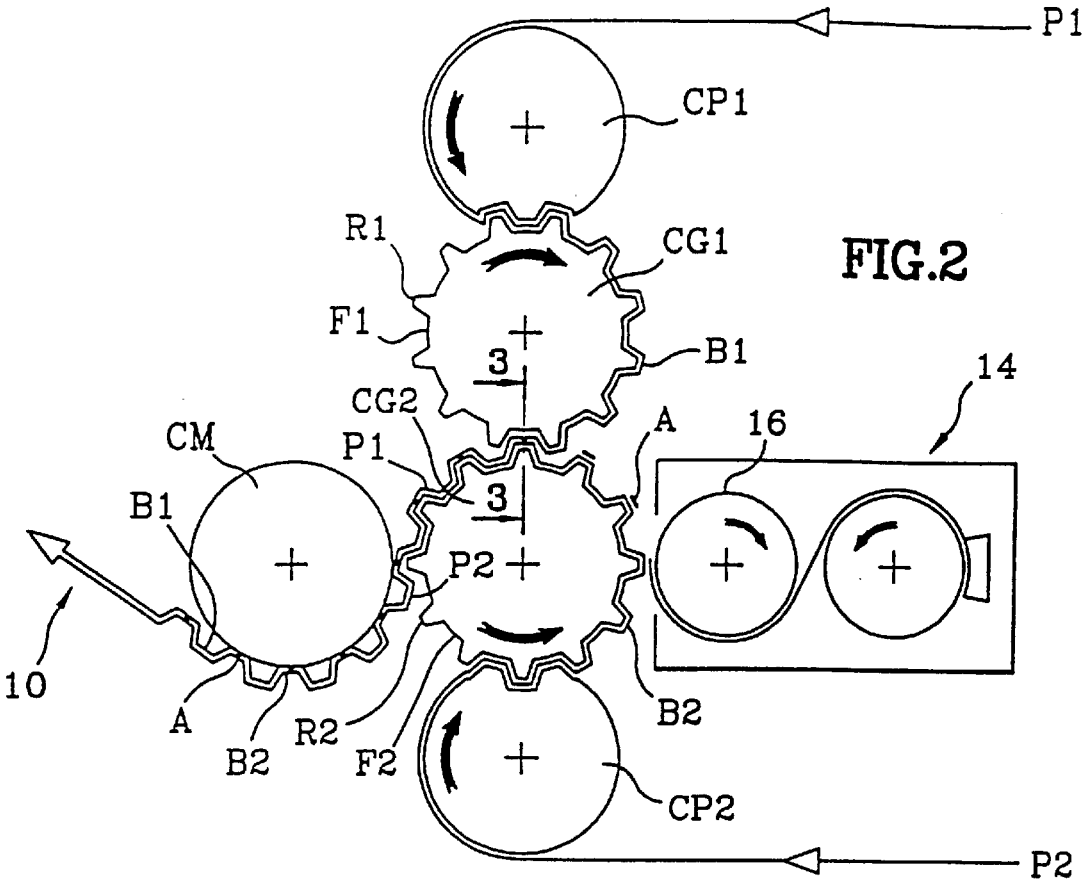
FIG. 2 is a schematic illustrating the design of apparatus implementing the manufacturing method of the invention.

The web 10 shown in FIG. 1 is made using the apparatus shown in FIG. 2.

This apparatus comprises two embossing units each constituted of a compressing cylinder CP1, CP2 and each clad with a flexible elastomer material and, respectively, cooperating with an engraved steel cylinder CG1, CG2.

The cylinders CG1 and CG2 are engraved in such a manner as to be fitted at their surfaces with salient elements and/or bosses R1, R2 distributed circumferentially in the direction of machine advance and in the transverse direction over the width of each cylinder.

Figure 3:
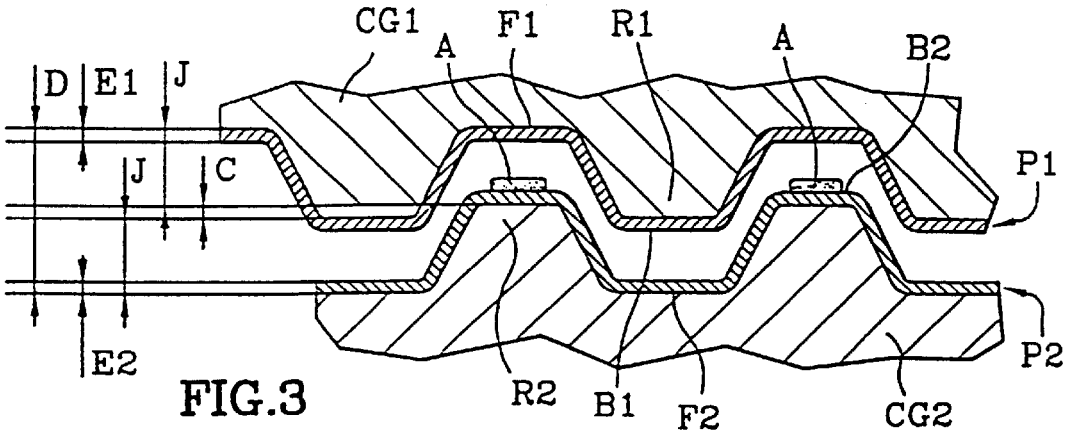
FIG. 3 is a schematic cross-section along line 3—3 of the Figure.

Under the disclosure of the invention and as shown in FIGS. 2 and 3, the axially parallel engraved metal cylinders CG1 and CG2 are so positioned relative to each other that they will mutually nest in their opposite zones, that is the salient parts R1 of one of the cylinders nest between the salient parts R2 of the other cylinder, the overlap C, also called cylinder engagement, however being such that a play J remains between the engraved cylinders CG1 and CG2 to allow inserting of the plies P1 and P2 between the engraved cylinders.

More specifically, the play J measured between the tops of the protrusions, such as R1, of one of the metal cylinders, CG1 and the opposite surface of the trough, for example F2, of the engraving of the other cylinder, CG2, is larger than or equal to the sum of the thicknesses E1 and E2 of the plies P1 and P2 when the latter are engaged in the mutual nesting zone of the cylinders CG1 and CG2.

Accordingly, J>E1+E2.

E1 and E2 are the thicknesses of the plies P1 and P2 in the nesting zone, that is of the plies P1 and P2 that were previously embossed before being simultaneously engaged between the cylinders CG1 and CG2 on account of their previous transit through the two embossing units.

The apparatus shown in FIG. 2 comprises an adhesive depositing device 14 known per se which deposits by means of an applicator cylinder 16 an adhesive A onto the tops of the salient protrusions B2 of one of these plies, in this case the ply P2 after the ply has been embossed by the cylinder CP2 associated to the cylinder CG2 but before the ply P2 has been engaged between the two engraved cylinders CG1 and CG2.

Thanks to the feature of the invention whereby the play J is larger than the sum of the thicknesses E1 and E2 of the previously embossed plies P1 and P2, the plies will not be compressed when being simultaneously engaged between the engraved cylinders CG1 and CG2 but, on the other hand, are mutually nesting and ready to be adhesively combined using a laminator roll CM which, like the compressing cylinders CP1 and CP2, is a cylinder having a flexible cladding of an elastomer material that, in the embodiment shown in the Figures, cooperates with an engraved metal cylinder CG2 to press the two previously embossed, adhesive-coated and mutually nesting plies P1 and P2 against the cylinder CG2.

Thanks to the mutual nesting of the two plies that was implemented when mutually engaging the two plies between the two cylinders CG1 and CG2, there is danger that the two plies might become mutually offset between the time when they leave their mutual engagement between the engraved cylinders CG1 and CG2 and the time when the two nested plies are engaged between the laminator roll CM and the engraved metal cylinder CG2.

Moreover, on account of the previous tight nesting of the two plies P1 and P2, but in the absence of compression, the pressure provided by the laminator roll CM on the engraved metal cylinder CG2 may be reduced, thereby avoiding the so-called "renewed engraving" of the ply P1 by the salient elements R2 of the engraved metal cylinder CG2.

The apparatus implementing the method of the invention of course also comprises regulating means (not shown) controlling the axis-to-axis distance of the two engraved cylinders CG1 and CG2 and, hence, controlling the distance D between the troughs F1 and F2 of the engravings of the two cylinders in their mutual nesting zone.

The method of the invention allows making deeper impressions in each of the two plies P1 and P2, for example by using an embossing pressure substantially corresponding to the limit of the flexible material of the cylinders CP1 and CP2 and, for example, being about 14 kg/cm$^2$.

Starting with creped paper, the method of the invention allows manufacturing in a reliable manner, that is in a defect-free manner, fiber products evincing high absorptivity and offering high softness to the touch.

Figure 4:
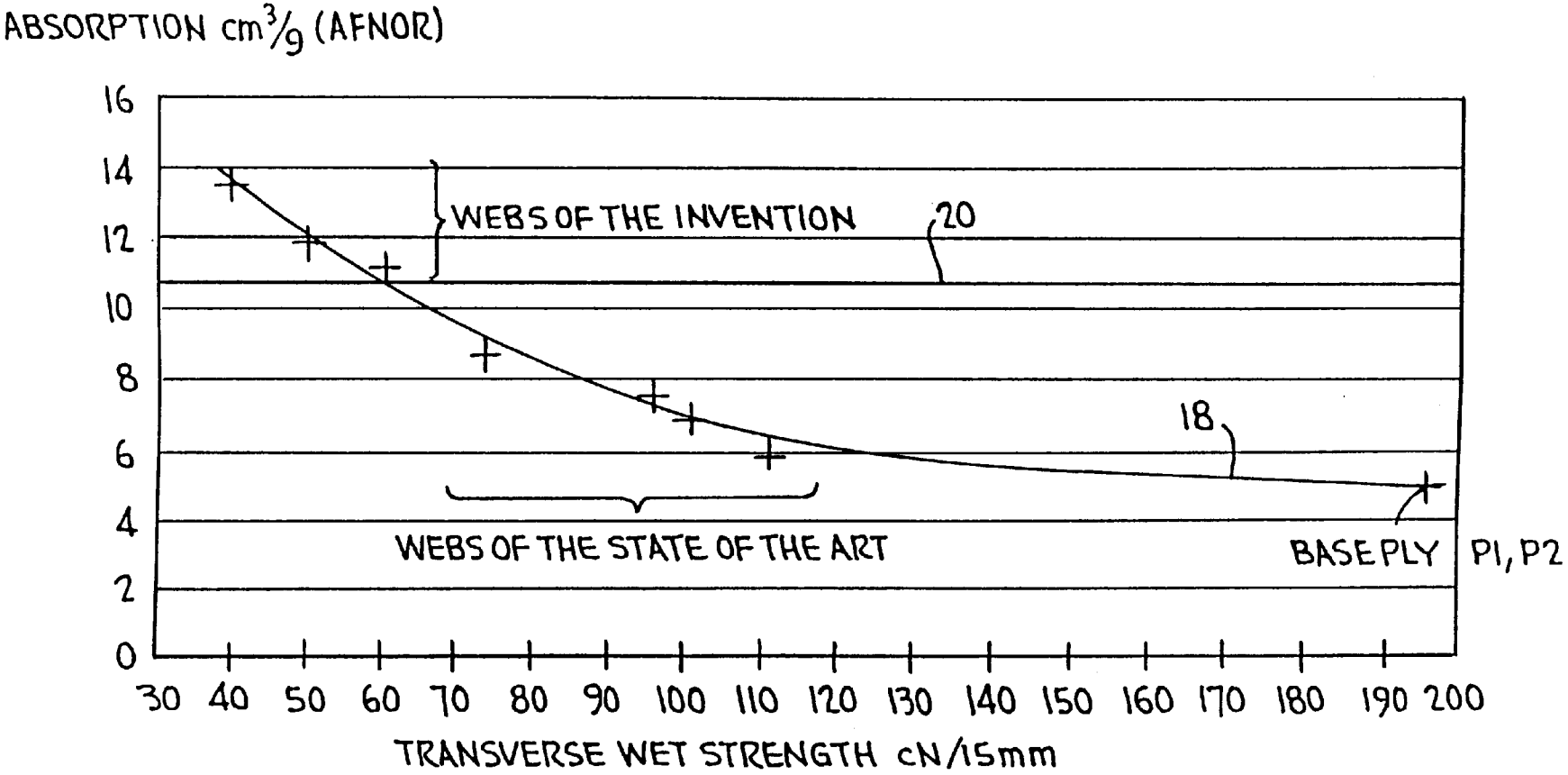
FIG. 4 is a plot showing the performance of a multi-layer web made in the manner of the invention.

The plot of FIG. 4 illustrates such performance. The plot shows the absorptivity in cm$^3$/g (ordinate) of an absorbent structure measured under the AFNOR NFQ 03068 Standards.

The abscissa shows the transverse wet strength in cN per 15 mm.

These measurements were taken after 15 minute aging at 125° C.

As shown by the plot, the sheet, i.e., the base ply, evinces absorptivity between 4 and 6 cm$^3$/g before embossing.

An absorbent structure of two nesting plies P1 and P2 made according to the state of the art evinces absorptivity generally between 6 and 10 cm$^3$/g and in all cases will be less than the limit value 20 of about 11 cm$^3$/g.

On the other hand, when the multi-layer absorbent structure is manufactured by the method of the invention, spot values are obtained which are shown on the left part of curve 18 of FIG. 4 that are above the limit value 20 and, in particular, are between 12 and 14 cm$^3$/g.

The invention is not restricted to the above described method of the invention. In particular, without transcending the scope of the invention, the adhesive A may be deposited onto the tops of the protrusions B1, B2 of the two plies P1 and P2 before they mutually engage between the engraved metal cylinders CG1 and CG2.

Nor is the invention restricted to manufacturing a two ply absorbent structure, it being possible to insert a previously embossed and fitted third ply between the plies P1 and P2, the third ply being simultaneously insertable between the engraved cylinders CG1 and CG2, in which case the play J of course will be equal to or larger than the sum of the thicknesses of the three previously embossed plies.

What is claimed is:

1. A method of manufacturing an absorbent structure having at least two plies with each ply constituted of at least one embossed absorbent paper sheet, said method comprising engaging the at least two plies between a first engraved cylinder and a second engraved cylinder, each engraved cylinder having protrusions with troughs between the protrusions and being driven in synchronized rotation, wherein a play is provided between tops of the protrusions of the first engraved cylinder and opposing surfaces in the troughs of the second engraved cylinder, prior to insertion of the at least two plies between the first engraved cylinder and the second engraved cylinder, matching each ply in shape totally or partially to a surface of an associated engraved cylinder by applying each ply against an associated engraved cylinder by an associated compressing cylinder having a flexible cladding material thereon, applying an adhesive onto salient zones of at least one ply of said at least two plies before the at least two plies are engaged between the first engraved cylinder and the second engraved cylinder, and combining the at least two plies by bonding following mutual engagement of the at least two plies between the first engraved cylinder and the second engraved cylinder by forcing the at least two plies against one engraved cylinder by a laminator roll fitted with a flexible cladding, wherein said play is less than a depth of the protrusions of the first engraved cylinder or of the second engraved cylinder and said play is larger than a sum of thicknesses of the at least two plies matched in shape so that the at least two plies are not compressed in any region when engaged between the first engraved cylinder and the second engraved cylinder.

2. Method as claimed in claim 1 wherein the adhesive is applied to salient zones of one of the at least two plies before the at least two plies are engaged between the first engraved cylinder and the second engraved cylinder.

3. Absorbent structure manufactured by the method of either claim 1 or claim 2, wherein each ply has an absorptivity of between 4 and 6 $cm^3/g$ and absorptivity of said absorbent structure, measured under AFNOR NFQ 03068 Standard, is between 11 and 14 $cm^3/g$ based on two plies of absorbent paper.

4. A method of manufacturing an absorbent structure as claimed in claim 1, wherein the absorbent structure has an absorptivity between 11 and 14 $cm^3/g$.

* * * * *

UNITED STATES PATENT AND TRADEMARK OFFICE

CERTIFICATE OF CORRECTION

PATENT NO. : 6,306,482 B1
DATED : October 23, 2001
INVENTOR(S) : Rémy Ruppel et al.

It is certified that error appears in the above-identified patent and that said Letters Patent is hereby corrected as shown below:

Title page,
"Item [30], Foreign Application Priority Data"
Mar. 7, 1996 (FR) …… 96 03779"

should read

-- [30] Foreign Application Priority Data
Mar. 27, 1996 (FR) ……... 96 03779 --.

Signed and Sealed this

Third Day of September, 2002

*Attest:*

*Attesting Officer*

JAMES E. ROGAN
*Director of the United States Patent and Trademark Office*